US008113223B2

(12) United States Patent
Wang et al.

(10) Patent No.: US 8,113,223 B2
(45) Date of Patent: Feb. 14, 2012

(54) TELESCOPING UMBRELLA

(75) Inventors: Zhonglin Wang, Zhejiang Province (CN); Kai Liu, Zhejiang Province (CN)

(73) Assignee: Yotrio Group Co., Ltd., Linhai, Zhejiang Province (CN)

( * ) Notice: Subject to any disclaimer, the term of this patent is extended or adjusted under 35 U.S.C. 154(b) by 0 days.

(21) Appl. No.: 12/531,455

(22) PCT Filed: Apr. 25, 2008

(86) PCT No.: PCT/DE2008/000707

§ 371 (c)(1),
(2), (4) Date: Sep. 15, 2009

(87) PCT Pub. No.: WO2008/135015

PCT Pub. Date: Nov. 13, 2008

(65) Prior Publication Data

US 2010/0101614 A1 Apr. 29, 2010

(30) Foreign Application Priority Data

May 7, 2007 (DE) ..... 10 2007 021 803

(51) Int. Cl.
*A45B 17/00* (2006.01)
*A45B 25/00* (2006.01)

(52) U.S. Cl. ..... 135/20.1; 135/20.3

(58) Field of Classification Search ..... 135/20.1, 135/20.3, 21, 25.4
See application file for complete search history.

(56) References Cited

U.S. PATENT DOCUMENTS

| | | | | |
|---|---|---|---|---|
| 3,486,514 | A * | 12/1969 | Prescott | 135/90 |
| 6,152,156 | A * | 11/2000 | Tung | 135/21 |
| 6,478,037 | B2 * | 11/2002 | Tung | 135/21 |
| 6,945,263 | B2 * | 9/2005 | Li et al. | 135/20.1 |
| 6,953,043 | B2 * | 10/2005 | Yu | 135/20.1 |
| 7,134,442 | B2 * | 11/2006 | Ma | 135/20.1 |
| 7,341,068 | B2 * | 3/2008 | Liu | 135/20.3 |
| 7,398,790 | B2 * | 7/2008 | Glatz | 135/20.1 |
| 2005/0268952 | A1 | 12/2005 | Joen-an Ma | |
| 2006/0254628 | A1 * | 11/2006 | Tseng | 135/20.1 |
| 2008/0041431 | A1 * | 2/2008 | Tung | 135/21 |
| 2008/0066791 | A1 * | 3/2008 | Ma | 135/15.1 |
| 2008/0236640 | A1 | 10/2008 | Huali et al. | |

FOREIGN PATENT DOCUMENTS

DE 44 07 188 12/1994

(Continued)

OTHER PUBLICATIONS

International Preliminary Report on Patentability and Written Opinion for Appl. No. PCT/DE2008/000707 dated Dec. 7, 2009.

(Continued)

*Primary Examiner* — Noah Chandler Hawk
(74) *Attorney, Agent, or Firm* — Jingming Cai; Schein & Cai LLP

(57) ABSTRACT

The invention relates to a telescoping umbrella, particularly a sun or rain umbrella, having a receiving tube and a telescoping tube displaceably and lockably located therein, having an umbrella roof connected to the telescoping tube in an articulating manner, the umbrella roof being adjustable by means of a cable or Bowden wire running inside the tubes, and having an actuating device for the cable or Bowden wire, characterized in that the actuating device comprises a winch for the cable or Bowden wire, the winch being located inside the receiving tube.

18 Claims, 7 Drawing Sheets

FOREIGN PATENT DOCUMENTS

| | | |
|---|---|---|
| DE | 200 14 895 | 12/2000 |
| DE | 20 2004 009 991 | 9/2004 |
| EP | 1 400 186 | 3/2004 |
| EP | 1 602 297 | 12/2005 |

OTHER PUBLICATIONS

International Search Report for International Application No. PCT/DE2008/000707.

* cited by examiner

TELESCOPING UMBRELLA

BACKGROUND OF THE INVENTION

1. Field of the Invention

The invention relates to a telescoping umbrella, in particular a parasol or rain umbrella, having a receiving tube and a telescoping tube situated therein so it is displaceable and lockable, having a canopy linked to the telescope tube, the canopy being adjustable using a cable pull or Bowden cable running inside the tubes, and having an actuating unit for the cable pull or Bowden cable.

2. Description of Related Arts

Umbrellas of the type under discussion have been known for many years from the leisure and garden field. Through their telescoping implementation, the canopy linked on the telescope tube may be brought into various positions in these umbrellas and locked there, whereby, on the one hand, upon usage of the umbrella, adaptability to different sun positions, wind directions, or the like is achieved. On the other hand, the umbrella may be collapsed easily to a small size when not in use, so that it may be stowed more easily.

Telescoping umbrellas are typically implemented as so-called hanging or suspended umbrellas, in which a canopy linked hanging on the upper end of the telescope tube, i.e., the end of the telescope tube facing away from the receiving tube, is spaced apart in the radial direction from the foot used to anchor the umbrella. The tubes supporting the canopy, i.e., the telescope tube and the receiving tube, typically have a curvature in the form of a circular arc for this purpose. The radial spacing of the canopy from the foot which is thus provided achieves the advantage that the area covered by the canopy may be exploited better.

Implementing a telescoping umbrella of the type under discussion in such a way that its canopy may be opened and closed using a cable pull or Bowden cable running inside the tubes is known from DE 10 2005 047 323 A1. The cable pull working together with the canopy runs from the upper end of the telescope tube—i.e., from the linkage point of the canopy on the telescope tube—through the telescope tube down to its lower end for this purpose and exits from the receiving tube there through an L-shaped connector part, on which a deflection unit is implemented. For this purpose, an oblong recess extending over the displacement path is implemented in the receiving tube. A cable winch, which is connected to the L-shaped connector part and is situated outside the receiving tube, and on which a hand crank is fastened, is used as the actuating unit for the cable pull.

It is to be viewed as disadvantageous in the known umbrella that to retract or extend the telescope tube, the housing of the cable winch must be grasped, which is in turn situated directly on the oblong recess implemented on the receiving tube. The danger thus exists that the user will pinch his fingers when actuating the hand crank and/or when retracting or extending the telescope tube. The actuating unit, including the hand crank, protruding to the exterior of the receiving tube also represents a hazard point, because people running around it could easily have their clothing hooked thereon. In addition, the construction shown has proven to have the disadvantage that the actuating unit is strongly subjected to environmental influences such as rainwater, dirtying by dust, and the like, which negatively impairs its functional capability and service life. Finally, the outwardly protruding actuating unit worsens the visual overall impression of the umbrella.

The present invention is therefore based on the object of designing and refining a telescoping umbrella of the type cited at the beginning in such a way that it can be operated reliably and easily, is made visually attractive, and its actuating unit for the cable pull or Bowden cable has a long service life.

SUMMARY OF VARIOUS EMBOPDIMENTS

The preceding object is achieved according to the invention by the features of claim 1. Accordingly, the telescoping umbrella under discussion is characterized in that the actuating unit comprises a winch for the cable pull or Bowden cable, the winch being situated inside the receiving tube.

It has first been recognized according to the invention that a winch, on which the cable, line, or the like of the cable pull or Bowden cable can be wound, is suitable for actuating the cable pull or Bowden cable. This winch has been refined according to the invention in that it is now situated inside the receiving tube instead of being implemented—as previously—as a component projecting outside the receiving tube. It is to be noted that alternatively to a winch, of course, comparable other means which conveys the cable pull or Bowden cable may be used. Different advantageous effects result through the configuration of the winch inside the receiving tube. Firstly, through the sheathing of the winch by the receiving tube, the mechanical functional elements of the winch are extensively protected from external environmental influences, in particular dirtying, rainwater, or the like, so that a longer service life results because of less wear, less corrosion, and less aging in general. Simultaneously, the advantage results for the user of the umbrella that its handling is safer, because the moving mechanical elements of the actuating unit are extensively housed inside the receiving tube. Hooking on protruding parts is thus prevented.

A further technical advantage of the umbrella according to the invention results in that the deflection unit required up to this point, which is situated in the L-shaped connector part, for guiding the cable pull or Bowden cable out of the receiving tube, is no longer required, so that the friction of the cable and thus the force required for adjusting the canopy are decreased, because the cable force is transmitted without deflection.

Finally, the visual impression of the umbrella according to the invention is significantly improved in that the winch is no longer externally visible.

In a preferred design of the umbrella according to the invention, the winch is associated with the telescope tube. The special advantage results in this way that the spacing between the winch and the canopy always remains equal. An opening/closing movement of the canopy possibly to be triggered by the cable pull or Bowden cable is therefore independent of how far the telescope tube is inserted into the receiving tube and/or withdrawn therefrom. The length of the umbrella can thus be changed arbitrarily, without colliding with the mechanism for adjusting the canopy. Furthermore, the advantage results that the telescope tube may plunge particularly far into the receiving tube, whereby a smaller storage space of the umbrella results in the collapsed state.

Alternatively, it is conceivable to associate the winch with the receiving tube, whereby a position of the winch which is independent of the insertion state of the telescope tube results. A configuration of this type may be advantageous for umbrellas having particularly large telescope displacement, in order to ensure that the winch is also accessible to the user when the telescope tube is extended.

The cable pull or Bowden cable can be implemented to fulfill various functionalities, in particular to adjust the canopy in different ways. In a preferred embodiment, it is implemented so that the canopy may be opened and closed using it. For this purpose, the cable pull or Bowden cable is connected directly or indirectly to a stretching mechanism of the canopy, so that the canopy is open upon tensioning of the cable pull or Bowden cable, for example.

Alternatively or additionally, the cable pull or Bowden cable can work together with the canopy in such a way that the canopy may be inclined by actuating the cable pull or Bowden cable and/or can be locked in an inclined position. An inclination of the canopy may be advantageously implemented by an articulated fastening of the canopy on the telescope tube. Depending on the embodiment of the linkage mechanism of the canopy, by tensioning the cable pull or Bowden cable, an inclination of the canopy relative to the horizontal plane can be initiated and/or the articulated suspension of the canopy may be locked in a specific position.

From a manufacturing and/or assembly viewpoint, it is favorable to mount the winch in a housing so it is rotatable. The housing is then in turn connected to the telescope tube or—with corresponding assignment of the winch—to the receiving tube. In particular in the event of the assignment of the winch to the telescope tube, which is described as preferable, the design possibility suggests itself of inserting a housing of this type at least partially into the lower end of the telescope tube for fastening. Fundamentally, it is also conceivable to implement the housing integrally with the corresponding tube. Simple manufacturing and subsequent assembly result in any case if the housing is implemented as a separate component, for example, as a plastic part (injection-molded part). Relatively complex housing shapes may also be produced cost-effectively by the injection molding technique. To allow simple assembly, it may also be advantageous to implement the housing as divided.

Good accessibility to the actuating unit is achieved even in the extended state of the telescope tube if the winch is situated on the end of the telescope tube facing away from the canopy (i.e., the lower end). The winch may be fastened inside the telescope tube or outside the telescope tube on its end for this purpose.

For actuating the winch, it is advantageous to provide a crank which can be connected directly or indirectly—for example, using a gear—to the winch. In order to reduce the risks of injury and promote the external appearance of the umbrella, the crank may be implemented as an element which is detachable from the umbrella, and which is first connected to the winch for the actuation thereof. In the connected state, the crank projects outside the receiving tube, in order to allow the user to actuate the winch comfortably.

For this purpose, one or more openings may be implemented in the receiving tube, through which an attachment section of the crank—which is to be connected to the winch—may be inserted. By implementing multiple openings along the displacement path of the telescope—or alternatively a correspondingly extended oblong hole—a connection of the crank to the winch is optionally made possible in different insertion states of the telescope tube. While the implementation of multiple individual openings ensures a high level of protection from contamination, if the opening is implemented as an oblong hole, the telescope tube may also be displaced in the inserted state of the crank.

For secure connection, a profile may be implemented on the attachment section of the crank, for example, in the meaning of a square, hexagon, or gearing. Furthermore, the attachment section can be provided with a securing element, which prevents the crank from slipping out of the winch axially. If it is to be necessary to achieve particularly high forces or particularly high speeds using the crank, it can be expedient to interpose a suitable gear. Alternatively or additionally to a manually operated winch, of course, it is also conceivable to drive the winch using a motor.

In a further advantageous design of the umbrella, a handle is connected to the telescope tube for manual displacement of the telescope tube. A handle of this type is preferably an ergonomically shaped handle, using which the force needed for retracting or extending the telescope tube may be applied comfortably. In order that a handle of this type is also easily reachable in the extended state of the telescope tube, it is to be situated at the lower end of the telescope tube. Various alternatives are conceivable for connecting the handle to the telescope tube. A connection having a simple construction results if a slotted opening, which extends along the displacement path of the telescope tube, is implemented in the receiving tube. The handle can be connected directly to the telescope tube in this case—for example, welded, screwed, glued, or the like.

In regard to the design of the handle, in an advantageous embodiment, it is implemented essentially as a body enclosing the receiving tube on a peripheral section. The advantage thus results that the handle can be supported around the circumference relative to the receiving tube, whereby a stiffer overall design results. Roller bodies may then advantageously be situated between the handle and the receiving tube, whereby the displaceability of the telescope tube is made easier because of decreased friction.

Furthermore, the winch is advantageously situated inside the handle. The canopy may then also be adjusted comfortably from the handle—which is primarily used for actuating the telescope tube—because the winch is always located at the same height as the handle. The functional integration thus provided increases the operational friendliness of the umbrella further, because the telescope and the adjustment of the canopy may be actuated without re-gripping.

In a further embodiment of the invention, the telescope tube is lockable relative to the receiving tube using an engagement element. This engagement element may be any suitable locking means, a pin, bolt, wedge, or the like being preferred in the design.

A technically favorable construction results if the engagement element is fixed in the axial direction on the telescope tube or on the handle and can be engaged with an opening in the receiving tube or a profile in the receiving tube. For this purpose, for example, holes may be introduced into the receiving tube at specific intervals—along the displacement path—in which the engagement element can engage. By fixing the engagement element in the axial direction of the telescope tube, a connection between telescope tube and receiving tube is produced upon engagement in the receiving tube. Instead of one or more openings implemented in the receiving tube, an axially running profile may also be implemented on the receiving tube, for example, in the meaning of gearing, notching, or the like, which then causes axial securing by working together with the engagement element.

A mechanically simple and simultaneously secure locking may advantageously be implemented in that the engagement element is implemented as a displaceable pin, the restoring force of a spring holding the engagement element in the engaged state with the receiving tube. It is thus ensured that the engagement element is held—without external force action—in the locked state and a displacement of the telescope tube is only possible by application of a counterforce by the user.

Particularly comfortable operation of the locking of the telescope tube can be achieved if the engagement element may be actuated using an operating element linked on the handle. An operating element of this type can be implemented, for example, as a handle-shaped lever, which is easily accessible to the user. To achieve the functionality, the operating element is connected to the engagement element—which is used to lock the telescope tube. This connection can be implemented in different ways, in the simplest case, an integral embodiment of operating element and engagement element being conceivable. Operating element and engagement element are mounted so they are displaceable or tiltable relative to the handle, for example. Alternatively to an integral embodiment, operating element and engagement element may be individual components, which are preferably connected to one another via a cable pull or Bowden cable. A construction of this type offers the advantage of a relatively free—ergonomically favorable—spatial configuration of the elements, because the cable pull or Bowden cable may be deflected easily in different directions. Deflection elements such as rollers or the like may be integrated in the handle for this purpose.

In a refinement of the umbrella according to the invention, a support tube is situated parallel to the telescope tube. This support tube is fundamentally a tube designed similarly to the telescope tube, the support tube in particular having a similar length and an equal curvature as the telescope tube. One purpose of the support tube is to increase the stiffness of the overall umbrella design, an increased twist stiffness also being achieved in addition to increased bending stiffness by the parallel configuration of the tubes. The support tube is preferably connected to the telescope tube at their ends facing toward the canopy for this purpose. Alternatively or additionally, the support tube and the telescope tube may be connected to one another at other points.

To ensure a secure hold, the receiving tube is then implemented as a double tube to separately receive the telescope tube and the support tube. The receiving tube comprises two separate tubes, which are situated parallel to one another, in this case. The telescope tube and the support tube are thus guided at a constant spacing from one another, whereby the desired high stiffness of the telescope results. The handle for actuating the telescope only has to be connected to one of the two tubes.

In an advantageous embodiment, the handle is only connected to the telescope tube using the support tube. In this case, the part of the receiving tube which receives the telescope tube is terminated around its entire circumference, while the part of the receiving tube which receives the support tube has a slotted opening along the displacement path, through which the handle is connected to the support tube. In this case, the handle is thus not directly connected to the telescope tube, but rather the support tube, which is connected at the upper end of the support tube to the telescope tube, is displaced directly by the handle. A construction of this type allows an externally extensively terminated configuration of the winch inside the receiving tube. The danger of injury is thus decreased further and the overall visual impression of the construction is improved further.

To ensure a smooth actuation of the telescope, it may be expedient to mount individual or all of the described moving components relative to the receiving tube using one or more roller bearings. Mounting of this type may be advisable in particular for the telescope tube and/or the crank housing and/or the support tube.

As already noted, in particular so-called hanging umbrellas are implemented as telescoping umbrellas, in order to thus achieve a radial spacing of canopy in relation to the foot. The tubes needed for suspending the canopy—i.e., the receiving tube, the telescope tube, and optionally an additional support tube—preferably have a curvature in the form of a circular arc at least in the telescoping section for this purpose. Of course, many of the advantages and effects described here may also be achieved using linear tubes—with corresponding umbrella design.

It is to be noted that round cross-sectional profiles are particularly suitable for the receiving tube, the telescope tube, and optionally the support tube because of the high buckling resistance on all sides. The buckling resistance may be deliberately increased in specific directions—preferably main load directions—by oval cross-sectional profiles.

BRIEF DESCRIPTION OF THE SEVERAL VIEWS OF THE DRAWINGS

There are now various possibilities for designing and refining the teaching of the present invention advantageously. For this purpose, reference is made, on the one hand, to the patent claims following claim 1 and, on the other hand, to the following explanation of a preferred exemplary embodiment of the invention on the basis of the drawing. In connection with the explanation of the preferred exemplary embodiment of the invention on the basis of the drawing, preferred designs and refinements of the teaching are also explained in general. In the figures of the drawing:

DETAILED DESCRIPTION

Figure 1:
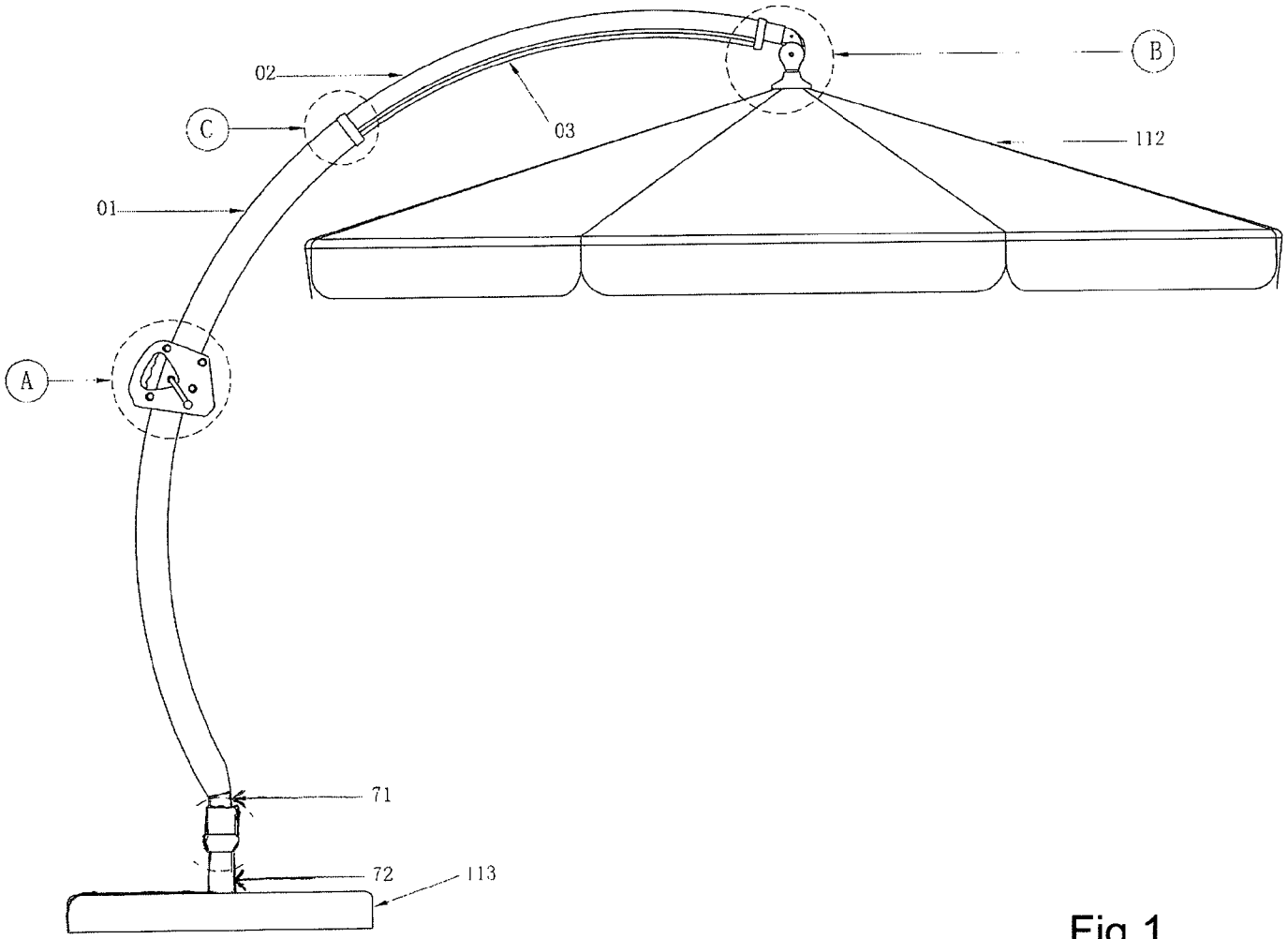
FIG. 1 shows a side view of an exemplary embodiment of the telescoping umbrella.
Figure 2:
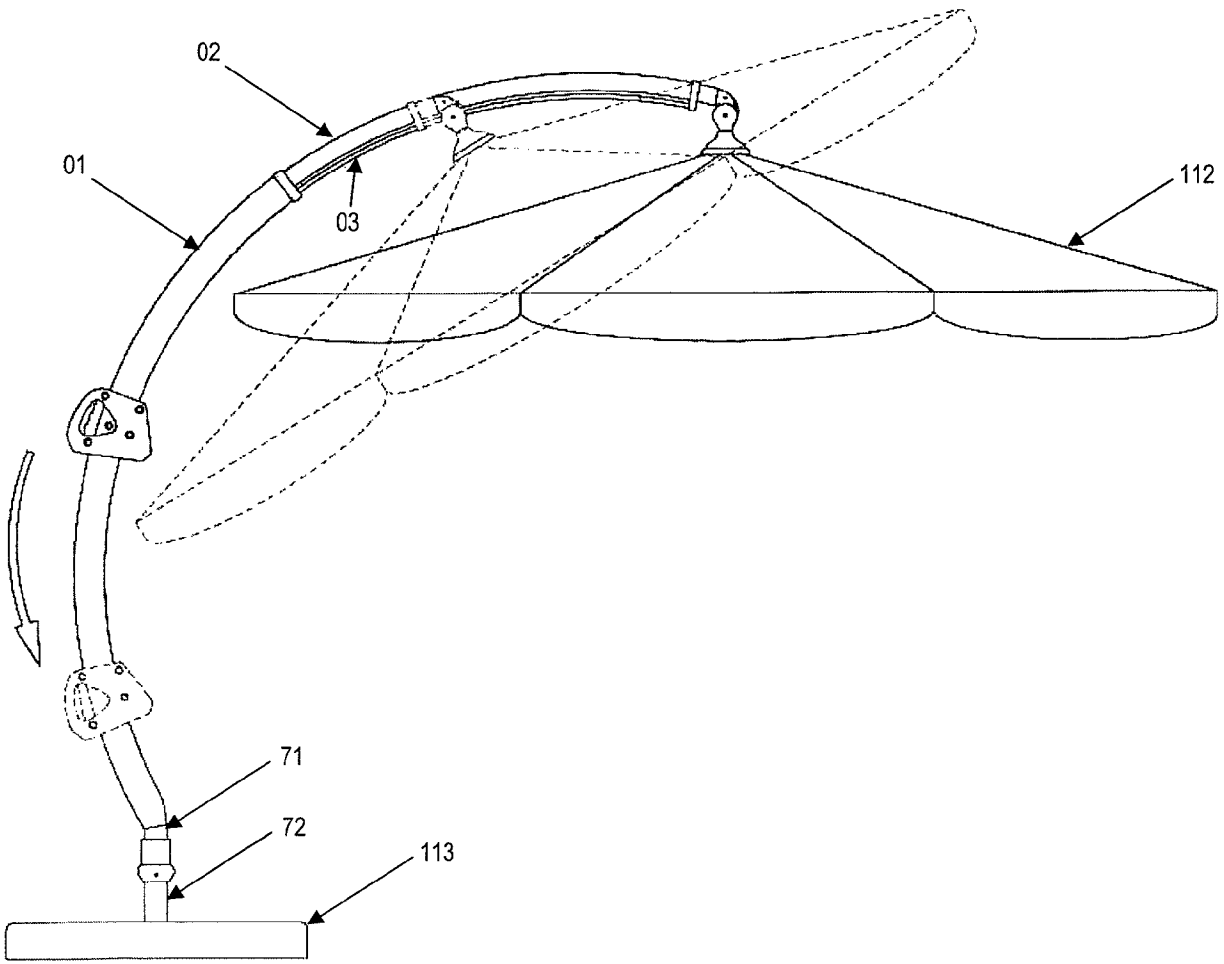
FIG. 2 shows a side view of the telescoping umbrella shown in FIG. 1 in two insertion states of the telescope tube.

FIG. 1 shows an exemplary embodiment of a telescoping umbrella according to the invention in a side view. The umbrella shown is a so-called hanging umbrella, in which the canopy 112 is radially spaced apart from the foot 113 using an arched support construction. The support construction essentially comprises the receiving tube 01, which is curved in the form of a circular arc, and in which the telescope tube 02, which is also curved in the form of a circular arc, is situated so it is displaceable and lockable. In the exemplary embodiment shown here, the receiving tube 01 is connected fixed to the rotating mast 71, which is used as an adapter, and which is mounted so it is rotatable (in the horizontal plane) relative to the standing mast 72. The standing mast 72 is in turn connected fixed to the foot 113. The canopy 112 is linked on at the upper end—i.e., the end facing toward the canopy 112—of the telescope tube 02. A support tube 03 is situated parallel to the telescope tube 02 and is connected at the upper end of the support tube 03 to the telescope tube 02. Because the support tube 03 is also mounted so it is displaceable relative to the receiving tube 01, the canopy 112, as shown in FIG. 2, may be brought into different positions by retracting or extending the telescope. The user grasps the handle, which is circled as detail A in FIG. 1, for this purpose in order to bring the canopy from an extended state (shown using solid lines in FIG. 2) into a retracted state (shown using dashed lines in FIG. 2). An adaptation of the canopy to various sun positions or a space-saving reduction in size of the umbrella when it is not in use is thus possible.

Figure 3:
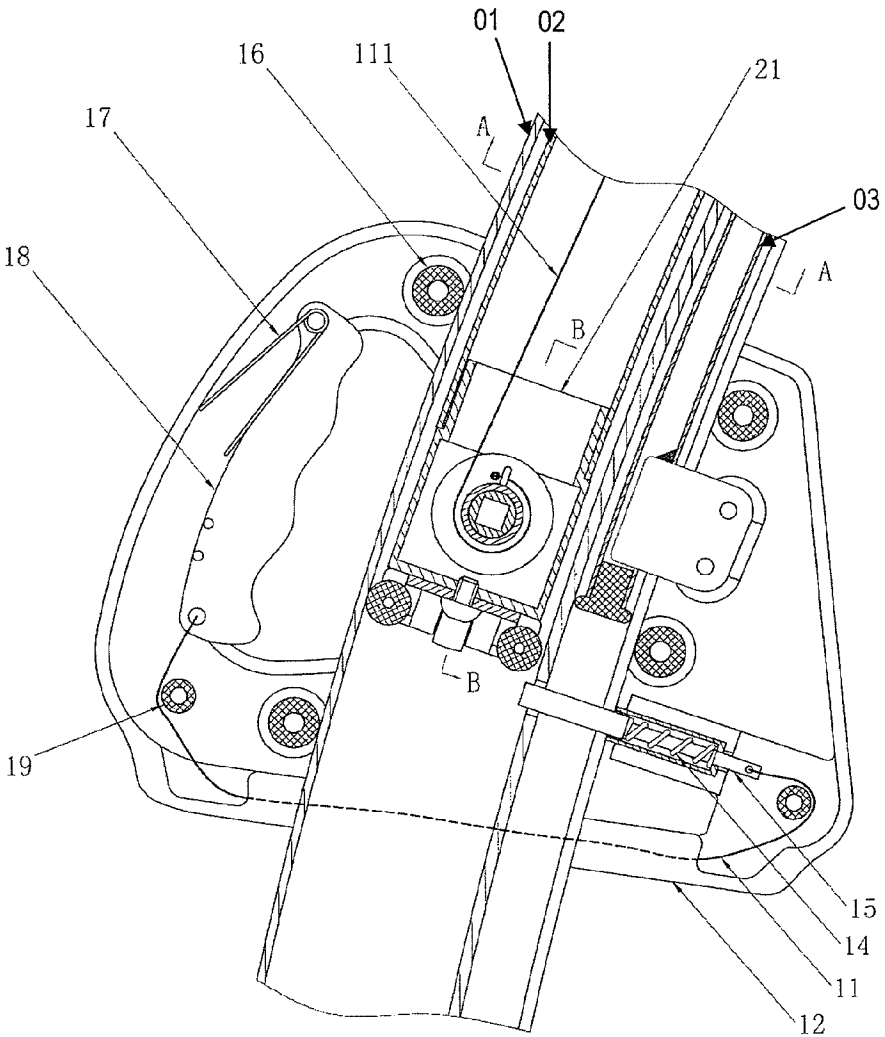
FIG. 3 shows a cross-sectional view of detail A from FIG. 1.
Figure 5:
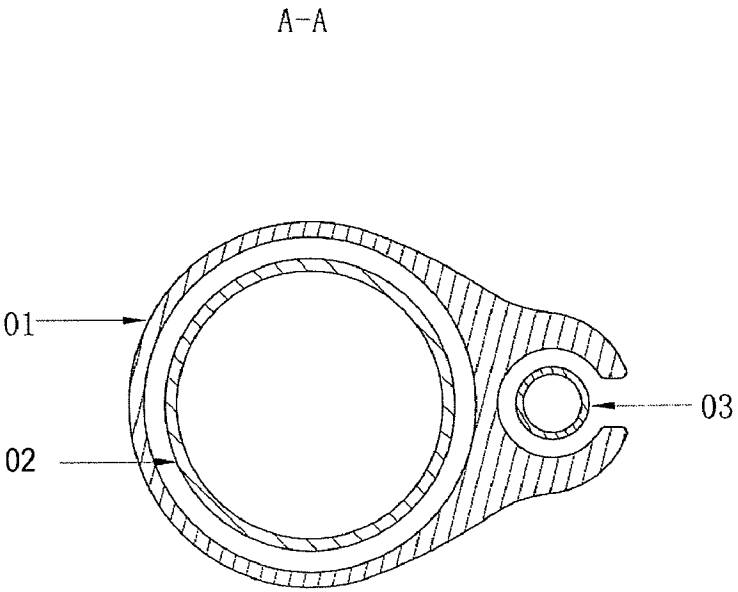
FIG. 5 shows a section along plane A-A from FIG. 3.

FIG. 3 shows the handle 12, which is circled in FIG. 1 as detail A, in a cross-sectional view. It may be seen therein that the telescope tube 02 and the support tube 03 are situated separately from one another in the receiving tube 01. The telescope tube 02 and the support tube 03 have—as shown in FIG. 5—a round cross-section, the telescope tube 02 being provided with a diameter multiple times greater than that of the support tube 03. The receiving tube 01 is implemented as a double tube, which completely encloses the telescope tube 02 around its circumference, while a slotted opening is provided along the displacement path of the telescope for the support tube 03.

Figure 8:
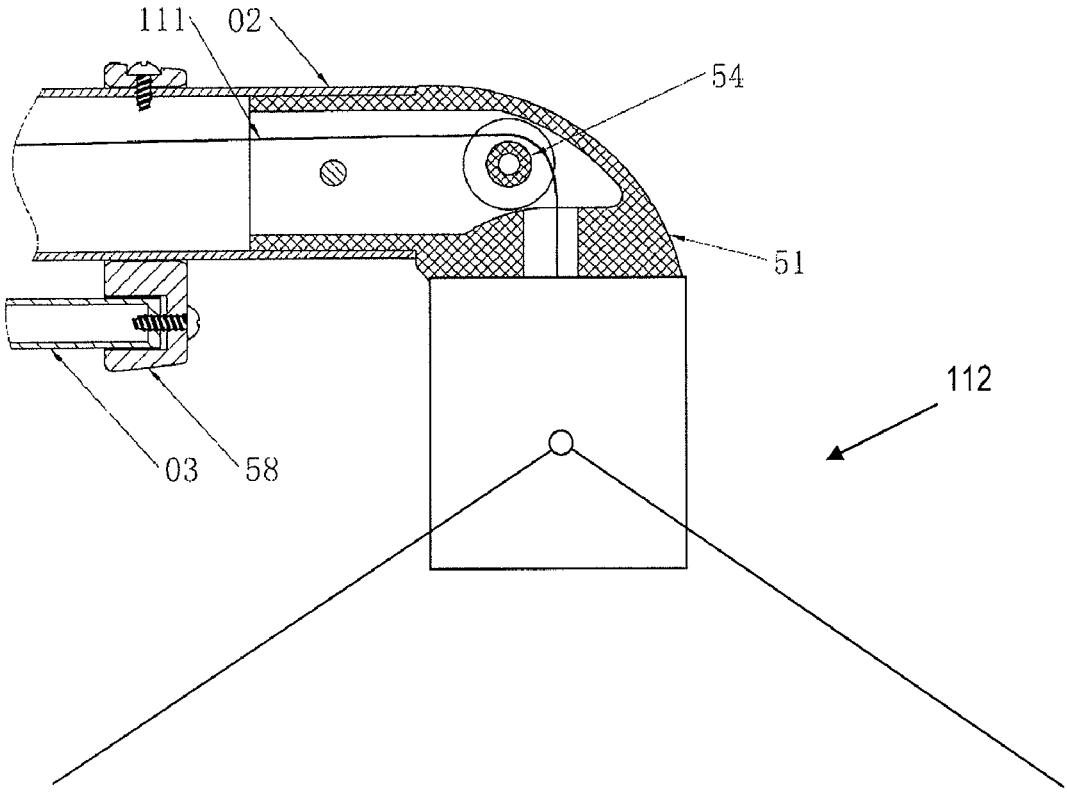
FIG. 8 shows a partially schematic cross-sectional view of detail B from FIG. 1.

According to FIG. 3, the handle 12 is fixedly connected using a connection element to the support tube 03. Because the handle 12 is mounted relative to the receiving tube 01 using the rollers 16, the handle 12 may be displaced smoothly in the axial direction of the receiving tube 01. The support tube 03 is thus directly displaced, which—as shown in FIG. 8—is connected to the telescope tube 02 at the upper end of the support tube 03. A displacement of the handle 12 thus results in a displacement of the telescope tube 02, although its lower end—i.e., the end visible in FIG. 3—is not connected directly to the handle 12.

For simple grasping of the handle 12, it is ergonomically shaped, as an injection-molded plastic part here. In the handle trough of the handle 12 situated on the left of the receiving tube Olin FIG. 3, an operating element 18 is situated so it is pivotable, this element being held by the spring 17, which is V-shaped in profile, in a starting state. The operating element 18 is rotatably connected to the handle 12 at the top left area. By pressing the operating element 18, a steel cable 11, which is connected to the locking pin 15, is tensioned. The steel cable 11 is guided through the handle 12 using deflection rollers 19. The locking pin 15, which is fixed on the handle 12, engages in a hole of the receiving tube 01 in the non-depressed state of the actuating handle 18—because of the restoring force of the coiled spring 14 acting on the locking pin 15. The handle 12—and thus the support tube 03 and the telescope tube 02—are thus limited in their displaceability. The locking pin 15 is only drawn out of the hole of the receiving tube 01 by actuating the actuating handle 18, so that the telescope may then be actuated. Holes are provided in the receiving tube 01 at various positions along the displacement path, at which locking can be performed.

Figure 4:
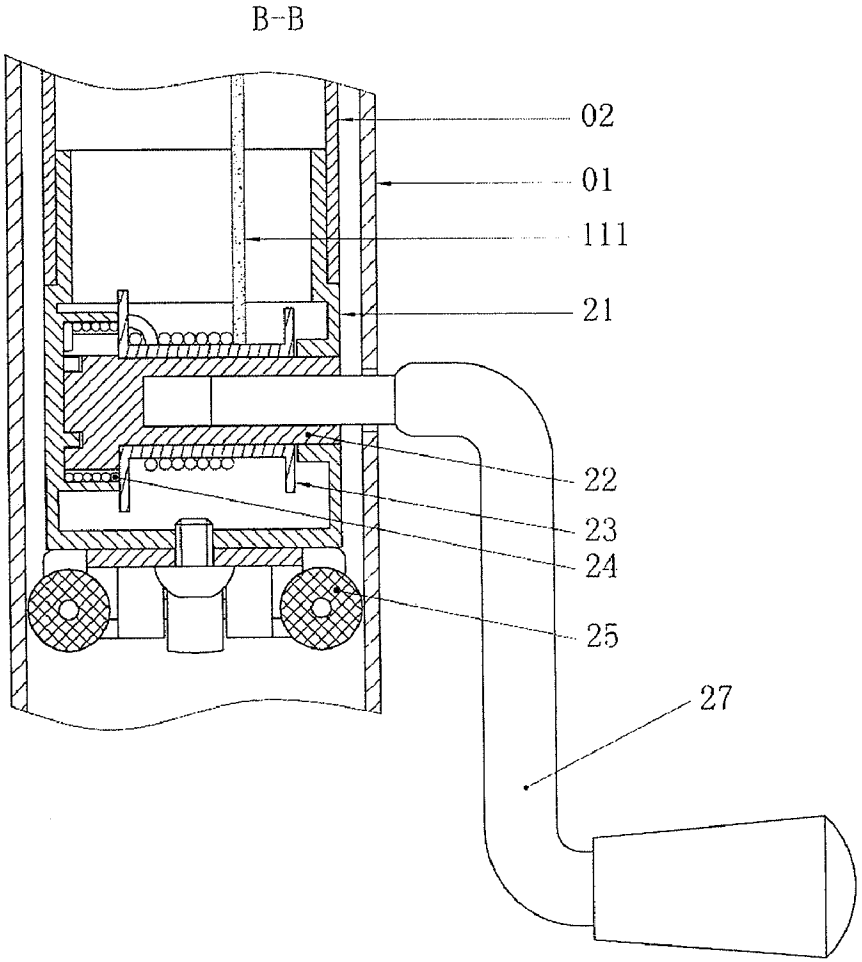
FIG. 4 shows a section along plane B-B from FIG. 3.

FIG. 4 shows a section along plane B-B from FIG. 3. A cable 111, which is used for opening and closing the canopy and for locking the canopy in an inclined position, is partially wound onto a winch 23. The winch 23 is mounted on the cable shaft 22 so it is rotatable in a housing 21, the housing 21 in turn being mounted so it is displaceable relative to the receiving tube 01 using rollers 25. The winch 23 is coupled to the housing 21 using a coiled spring 24, so that by increasing rotation of the winch 23 relative to a starting position, the coiled spring 24 is tensioned and thus develops a rising counterforce. Upon corresponding winding of the cable 111 on the winch, the counterforce may advantageously be used for the purpose of compensating for forces engaging at the other end of the cable 111, for example, reducing the force to be applied by the user to stretch out the canopy. In contrast to the illustration from FIG. 3, a crank 27 is inserted into the cable shaft 22 of the winch 23 in FIG. 4. An attachment section of the crank 27 is implemented as a square for this purpose (compare view from FIG. 3), so that a secure transmission of the torque is ensured.

Figure 6:
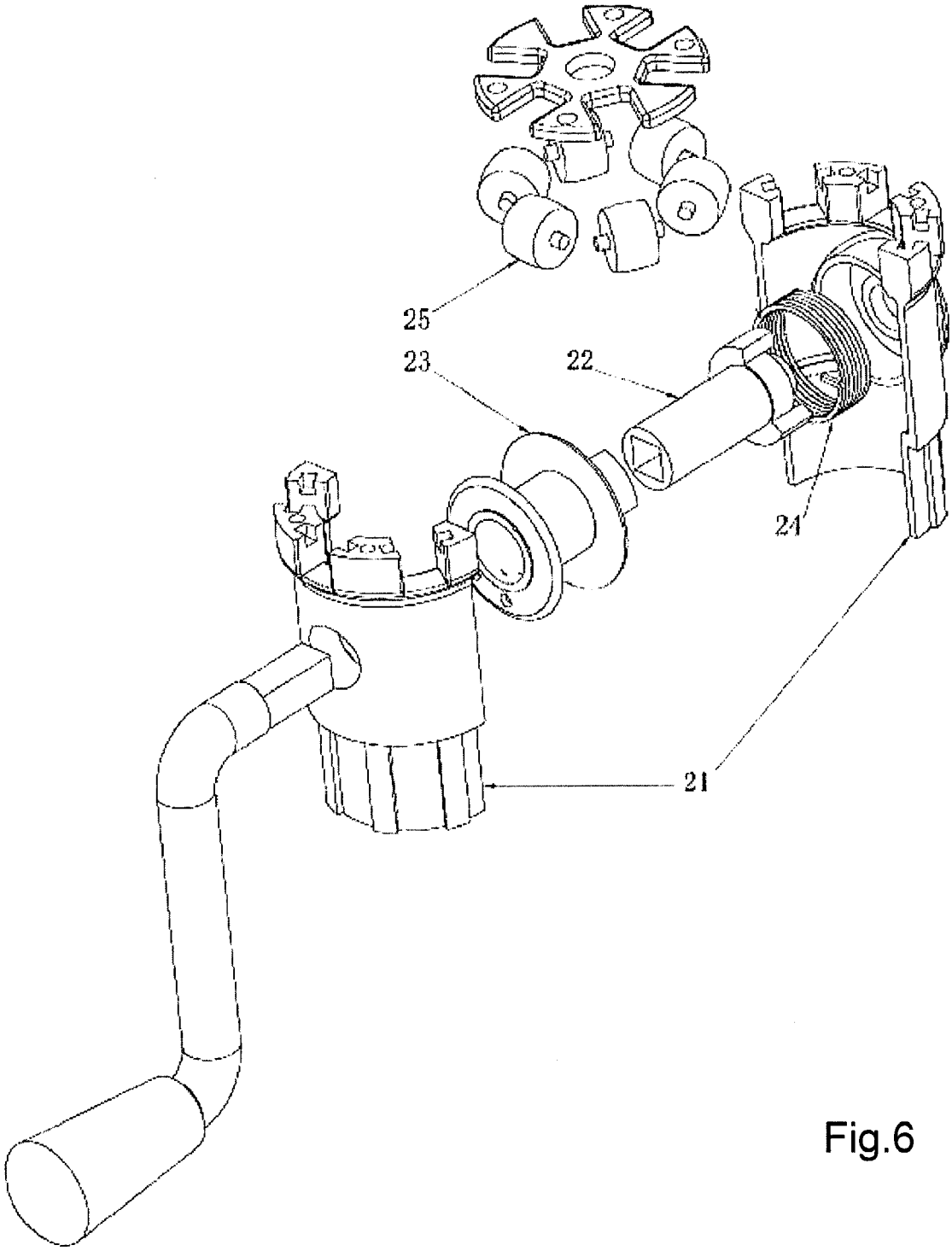
FIG. 6 shows an exploded illustration of the mounting of the winch.

The construction of the housing 21 is further illustrated in FIG. 6, where it may be seen that the housing 21 is divided axially into two halves. For smooth mounting of the housing 21, six rollers 25 are received in recesses of the two housing halves. The winch 23 is pushed onto the cable shaft 22, engages rotationally fixed therein using a shaft-hub connection and is coupled to the housing 21 using the coiled spring 24. It is to be noted that the view provided in FIG. 6 is rotated by 180° relative to the views from FIG. 3 and FIG. 4. Accordingly, the lower area of the housing 21 in FIG. 6 is inserted into a lower section of the telescope tube 02 according to FIG. 4 or FIG. 3.

Figure 7:
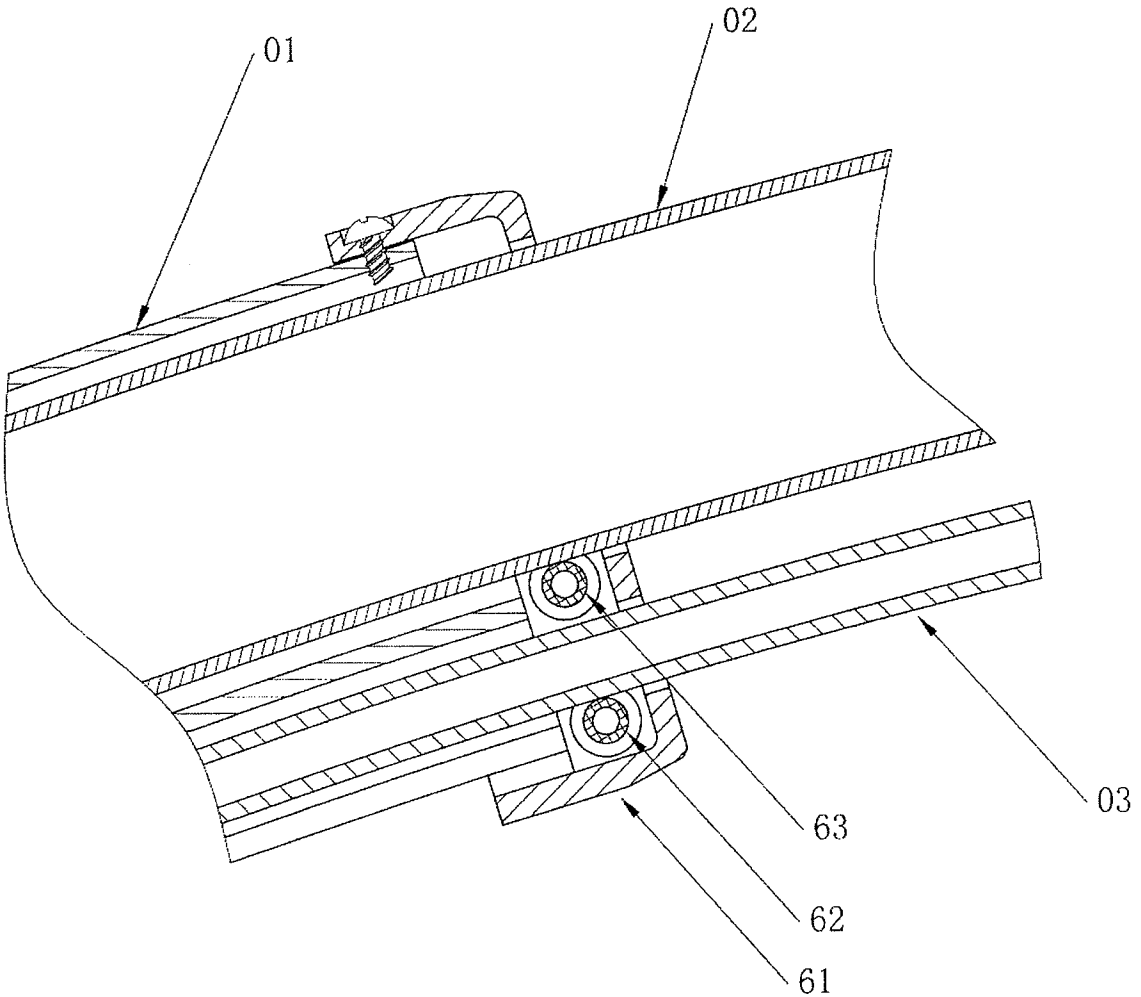
FIG. 7 shows a cross-sectional view of detail C from FIG. 1.

FIG. 7 shows the mounting of the telescope tube 02 and the support tube 03 on the upper end of the receiving tube 01 in a cross-sectional view corresponding to detail C from FIG. 1. Accordingly, the upper end of the receiving tube 01 is terminated by a cap 61, the rollers 62, 63, on which the telescope tube 02 and the support tube 03 are roller-mounted, being situated on the cap 61. The cap 61 seals the upper end of the receiving tube 01 relative to rainwater and dirt.

Finally, the linkage of the canopy 112 on the upper end of the telescope tube 02 is shown according to detail B from FIG. 1 in a partial schematic cross-sectional view in FIG. 8. It may be seen that the upper end of the support tube 03 is fastened using the connector part 58 on the telescope tube 02. The cable 111, which runs from the winch 23 (compare FIG. 4) through the telescope tube 02, is redirected at the upper end of the telescope tube 02, using the roller 54 situated in the joint head 51, into the canopy 112. In the exemplary embodiment, the cable 111 may be used for the purpose of opening and closing the canopy 112 and being able to lock it in an inclined position. The canopy 112 is suspended in an articulated way on the joint head 51 for this purpose and may thus be inclined relative to the horizontal plane.

To avoid repetition, reference is made to the general part of the description and to the appended patent claims in regard to further advantageous embodiments of the telescoping umbrella.

Finally, it is to be expressly noted that the exemplary embodiment described above of the telescoping umbrella according to the invention is only used for explaining the claimed teaching, but this teaching is not restricted to the exemplary embodiment. In particular, it is to be emphasized that the described idea on which the invention is based may fundamentally be applied to any construction of telescoping umbrellas, and accordingly, it is not restricted to the field of suspended or hanging umbrellas.

The invention claimed is:

1. A telescoping umbrella, in particular a parasol or rain umbrella, said telescoping umbrella comprising:

a receiving tube and a telescoping tube, which is situated so it is displaceable and lockable in the receiving tube;

a canopy, which is linked on the telescoping tube, the canopy being adjustable using a cable pull or Bowden cable running inside the tubes; and an actuating unit for the cable pull or Bowden cable, wherein the actuating unit comprises a winch for the cable pull or Bowden cable, the winch being situated inside the receiving tube;

wherein a handle is connected to the telescoping tube for the manual displacement of the telescoping tube, wherein the handle is situated at the lower end of the telescoping tube, wherein the handle is implemented essentially as a body which encloses the receiving tube on a peripheral section, wherein the winch is situated inside the handle, wherein the handle is fixedly connected to at least one portion of the telescoping tube, and wherein the handle is mounted using rollers to the receiving tube, wherein the handle is displaced smoothly in an axial direction relative to the receiving tube, and wherein the handle has a displacement that results in a displacement of the telescoping tube, although a lower end of the telescoping tube is free of connection directly to the handle, and wherein the winch is protected within the handle to prevent a pinch risk relative to the crank or when the telescoping tube retracts or extends, wherein at least one structure blocks the winch and foreign matter, and wherein the handle is free of a direct connection to the lower end of the telescope tube, but rather is connected to a support tube which is located substantially parallel to the telescoping tube, which is connected at an upper end of the support tube to the telescoping tube, and is displaced directly by the handle, wherein the winch being blocked reduces a danger of injury and provides an overall visual improved impression.

2. The telescoping umbrella according to claim 1, wherein the winch is associated with the telescoping tube.

3. The telescoping umbrella according to claim 1, wherein the canopy is configured to be opened and closed using the cable pull or Bowden cable.

4. The telescoping umbrella according to claim 1, wherein the canopy is configured to be inclined and/or locked in an inclined position using the cable pull or Bowden cable.

5. The telescoping umbrella according to claim 1, wherein the winch is mounted in a housing so it is rotatable.

6. The telescoping umbrella according to claim 1, wherein a crank is configured to be connected directly or indirectly to the winch, the crank projecting outside the receiving tube for actuation of the winch.

7. The telescoping umbrella according to claim 6, wherein an opening is implemented or multiple openings are implemented in the receiving tube, through which an attachment section of the crank is configured to be inserted.

8. The telescoping umbrella according to claim 1, wherein the telescoping tube is lockable relative to the receiving tube using an engagement element.

9. The telescoping umbrella according to claim 8, wherein the engagement element is fixed in the axial direction on the telescoping tube or on the handle and is configured to be engaged with an opening in the receiving tube or a profile on the receiving tube.

10. The telescoping umbrella according to claim 8, wherein the engagement element is implemented as a displaceable pin, the restoring force of a spring holding the engagement element in the engaged state with the receiving tube.

11. The telescoping umbrella according to claim 8, wherein the engagement element is configured to be actuated using an operating element, which is linked on the handle.

12. The telescoping umbrella according to claim 11, wherein the operating element is connected to the engagement element via a cable pull or Bowden cable.

13. The telescoping umbrella according to claim 1, wherein the support tube is situated parallel to the telescoping tube, the support tube being connected to the telescoping tube at ends facing toward the canopy.

14. The telescoping umbrella according to claim 13, wherein the receiving tube is implemented as a double tube to separately receive the telescoping tube and the support tube.

15. The telescoping umbrella according to claim 13, wherein the handle is only connected to the telescoping tube using the support tube.

16. The telescoping umbrella according to claim 13, wherein the receiving tube has a slotted opening, which extends over the displacement path, for fastening the handle on the support tube.

17. The telescoping umbrella according to claim 1, wherein the telescoping tube and/or a crank housing and/or the support tube is/are mounted relative to the receiving tube using one or more roller bearings.

18. The telescoping umbrella according to claim 1, wherein the tubes have a curvature in the form of a circular arc at least in the telescoping section.

* * * * *